US007811055B2

(12) United States Patent
Stommel et al.

(10) Patent No.: US 7,811,055 B2
(45) Date of Patent: Oct. 12, 2010

(54) FAN HOUSING FOR A HEAT EXCHANGER, PARTICULAR FOR MOTOR VEHICLES

(75) Inventors: Markus Stommel, Siegburg (DE); Markus Höglinger, Stuttgart (DE)

(73) Assignee: Behr GmbH & Co. KG, Stuttgart (DE)

( * ) Notice: Subject to any disclaimer, the term of this patent is extended or adjusted under 35 U.S.C. 154(b) by 1364 days.

(21) Appl. No.: 11/113,321

(22) Filed: Apr. 25, 2005

(65) Prior Publication Data

US 2005/0271529 A1 Dec. 8, 2005

(30) Foreign Application Priority Data

Apr. 26, 2004 (DE) ..... 10 2004 020 508

(51) Int. Cl.
*F04D 29/44* (2006.01)
*F04D 29/54* (2006.01)

(52) U.S. Cl. ..... 415/191; 415/208.2

(58) Field of Classification Search ..... 415/191, 415/208.2, 208.4, 208.5, 211.1, 220; 416/247 R, 416/192

See application file for complete search history.

(56) References Cited

U.S. PATENT DOCUMENTS

| | | | | |
|---|---|---|---|---|
| 2,142,307 | A * | 1/1939 | De Mey Rene et al. | 417/423.15 |
| 2,224,519 | A | 12/1940 | McIntyre | |
| 2,557,223 | A * | 6/1951 | Hans | 417/423.15 |
| 3,883,264 | A * | 5/1975 | Rao | 415/119 |
| 3,995,970 | A | 12/1976 | Nobuyuki | |
| 4,685,513 | A | 8/1987 | Longhouse et al. | |
| 5,246,339 | A | 9/1993 | Bengtsson et al. | |
| 5,342,167 | A * | 8/1994 | Rosseau | 415/119 |
| 5,758,716 | A * | 6/1998 | Shibata | 165/41 |
| 6,139,265 | A * | 10/2000 | Alizadeh | 415/208.1 |
| 6,595,744 | B2 * | 7/2003 | Van Houten | 415/173.1 |
| 2004/0007010 | A1 | 1/2004 | Kopf et al. | |
| 2004/0012125 | A1 | 1/2004 | Plant et al. | |
| 2006/0147304 | A1 * | 7/2006 | Cho et al. | 415/191 |

FOREIGN PATENT DOCUMENTS

| | | | |
|---|---|---|---|
| DE | 607134 | C | 12/1934 |
| DE | 90 17 417.8 | U1 | 3/1991 |
| DE | 41 05 378 | A1 | 8/1992 |
| DE | 42 44 037 | A1 | 6/1994 |
| DE | 196 38 518 | A1 | 4/1998 |
| EP | 1 016 790 | A2 | 7/2000 |
| FR | 78 447 | E | 7/1962 |
| FR | 1360211 | A | 5/1964 |
| GB | 733544 | | 7/1955 |
| JP | 03-189304 | A | 8/1991 |

* cited by examiner

*Primary Examiner*—Edward Look
*Assistant Examiner*—Dwayne J White
(74) *Attorney, Agent, or Firm*—Foley & Lardner LLP

(57) ABSTRACT

The invention relates to a fan housing for an air-flow heat exchanger having a fan blower comprising an axial-flow fan and a drive motor, the blower being connected to the fan housing by struts and the struts having a cross-sectional profile with a front edge and a rear edge. It is proposed that the struts, particularly their front and/or their rear edges, be arranged in a spherical or spheroidal surface enveloping them.

12 Claims, 7 Drawing Sheets

FAN HOUSING FOR A HEAT EXCHANGER, PARTICULAR FOR MOTOR VEHICLES

This application claims priority from Federal Republic of Germany application No. 10 2004 020 508.6 filed Apr. 26, 2004, which is incorporated herein by reference in its entirety.

The invention relates to a fan housing for an air-flow heat exchanger.

In fan assemblies having a fan blower, fan housings are used to channel the air flow and to support the fan blower. In motor vehicles, in particular, a fan housing is arranged downstream of a heat exchanger, such as a coolant radiator, in the direction of the air flow, the housing being fixed to the heat exchanger and having a circular case, inside which an axial-flow fan driven by an electric motor rotates in order to deliver the air flow through the heat exchanger. The electric motor with the fan, or fan blower to be concise, is connected by individual struts in the form of multiple integrally formed, injection-molded plastic components, to the case or the fan housing. Such a fan or radiator assembly for a motor vehicle was disclosed in DE-A 42 44 037 of the present applicant. In this case the fan housing is fixed by means of snap connections to the radiator and the fan blower is fixed to a fixing ring, which is held by struts arranged radially and basically in one plane. The forces and moments acting on the struts, which result from the weight and the inertial forces of the blower together with electric motor, from the reaction moment and the axial thrust of the fan, are considerable, so that the struts must accordingly be of substantial dimensions. In the axial direction, in particular, there must be sufficient rigidity in order that the fan or the motor will not strike or brush against the heat exchanger. On the other hand the struts should occupy only a minimal proportion of the case cross section, in order to minimize the flow losses for the air flow delivered by the fan. For this reason the struts are designed to be as slender and aerodynamic as possible, sometimes also with an aerodynamic profile. A further problem in the deign and dimensioning of the struts are fan noises which result from the air flow due to static struts and rotating fan blades.

In order to prevent the generation of such noises, DE-A 41 05 378 proposed that the struts bracing the blower in a fan assembly with fan housing and fan blower be arranged obliquely to the radial direction, preferably at an angle of inclination of 20°.

In order to prevent fan noises it was further proposed in DE-A 196 38 518 that the retaining struts for the electric motor and the axial-flow fan be arranged between the heat exchanger and the axial-flow fan, that is to say upstream of the fan. The struts fixed to an outer support ring in this case run basically i.e. in the area of the fan diameter in a plane perpendicular to the axis of rotation of the fan. In order to absorb the shear forces generated in an axial direction by the fan and the inertial forces caused by acceleration and deceleration of the vehicle, the struts must have an adequate resistance moment, which has a negative effect on the weight and the overall depth, and in terms of the pressure drop of the delivered air flow.

An object of the present invention is to improve a fan housing of the type specified in the introductory part in respect of its axial rigidity, as far as possible without increasing the weight, the number and/or the cross sections of the struts.

SUMMARY OF THE INVENTION

According to the invention the struts are curved in such a way that with both their leading edges and their trailing edges they span a curved expanse, which preferably forms the surface of a spheroid or a dome. This "dome effect" gives the struts a greater design strength, that is to say, in particular, a greater rigidity in an axial direction, without it being necessary to increase the number of struts or to substantially enlarge the cross section in order to achieve this. Better and more uniform use is thereby made of the potential of the material, whether this is a plastic or a light metal die casting.

In an advantageous development of the invention an envelope, for example the surface of a spheroid (paraboloid, ellipsoid), is generated by rotation of a curve branch about the axis of rotation of the blower. The curve branch may be part of a circle, a parabola, an ellipse or some other non-linear curve, the distance of which in an axial direction to a radial plane increases constantly in a radial direction from the inside outward. This endows the struts with a similar bracing effect to that familiar in domes or arches, especially in the radially outer area where the mechanical stresses are also greatest.

In an advantageous development of the invention the struts may be arranged on the one hand between the heat exchanger and the fan, that is upstream of the fan in the flow direction, and downstream of the fan in the flow direction. Embodiments in which the distance between the front edges of the fan and the rear edges of the struts, or the distance between the rear edges of the fan and the front edges of the struts increases radially from the inside outward, afford particular advantages in terms of aerodynamics and the generation of noise, because the greatest flow velocities occur and the largest delivery capacities are attained in the area of the outer diameter, whilst at the same time the distance between the fan and the struts is greatest. This brings a distinct reduction in harmful interferences.

The object of the invention is also achieved by the features of patent claim 10. According to the invention the struts are inclined or curved in different circumferential directions and form a strut lattice. This affords the advantage of axial and radial reinforcement.

The differently inclined struts may advantageously be of different dimensions, that is to say they may take the form of compression and tensile struts, the compression struts being of more solid dimensions than the tensile struts. This affords the advantage of a further saving in material, together with a smaller pressure drop in the air flow. Arranging the struts in a lattice pattern is valid both for struts which are arranged basically in one plane or on a conical surface, and for struts which have spherical or spheroidal curvatures.

In a further advantageous development of the invention a reinforcement of the cross section of the struts is also provided, particularly in the area of the outside diameter where the greatest bending stresses occur due to axial loading. The strut cross sections therefore increase with an increasing radius, it being possible to increase either the strut height (in the air-flow direction) or the strut width (transversely to the air-flow direction). This has the advantage of affording a further increase in the axial rigidity of the blower suspension.

According to one advantageous embodiment of the invention the points of intersection are arranged in areas having a basically axial throughflow. Since a radial component of the throughflow is minimal in these areas, the points of intersection in such an arrangement constitute a smaller flow resistance.

BRIEF DESCRIPTION OF THE DRAWINGS

Exemplary embodiments of the invention are represented in the drawing and will be described in more detail below. In the drawing.

DETAILED DESCRIPTION OF THE INVENTION

Figure 1:
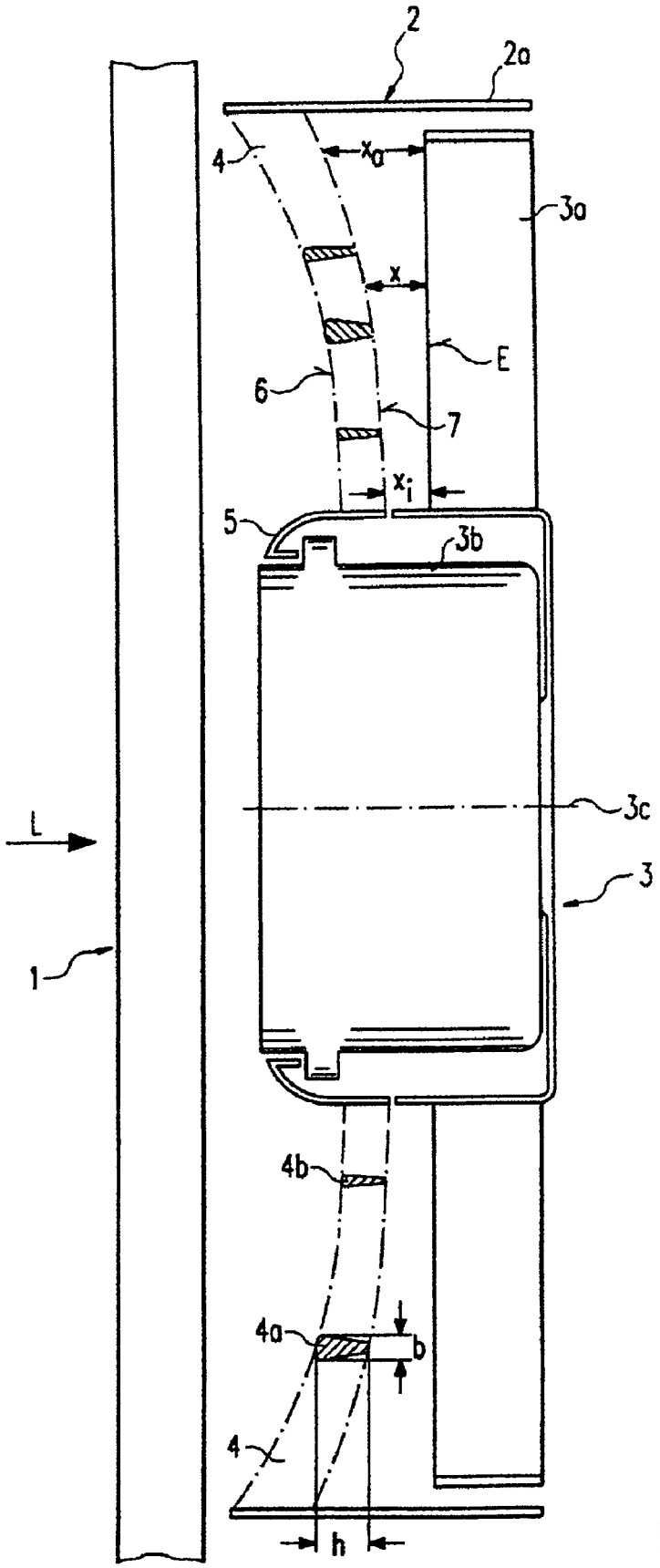
FIG. 1 shows a first exemplary embodiment of the invention with struts, curved in opposition to the air-flow direction, between the heat exchanger and the fan.

FIG. 1 shows an arrangement of a heat exchanger 1, a fan housing 2 and a fan blower 3, which is fixed in relation to the fan housing 2 by a number of struts 4. The heat exchanger 1 may preferably take the form of a coolant/air radiator of a motor vehicle and may be arranged in a front engine compartment (not shown) of a motor vehicle. For the sake of simplicity only the network of the radiator 1 is represented, through which ambient air flows in the direction of the arrow L. The fan housing 2 is likewise not represented in full, the housing being connected to the radiator 1, for example by a snap connection, in a manner not shown but known from the state of the art. At its downstream end the fan housing 2 has a case 2*a*, in which an axial-flow fan 3*a* rotates, which is driven by an electric motor 3*b*. The common axis of rotation is denoted by 3*c*. The blower 3 comprising the electric motor 3*b* and the fan 3*a* has a retaining ring 5, to which the struts 4 are fixed, thereby holding the blower 3 inside the fan housing 2; the blower 3 is thereby fixed both in a radial direction in relation to the fan case 2*a* and in an axial direction in relation to the network of the radiator 1. In cross section the struts 4 have an aerodynamic profile 4*a*, which is characterized by a strut height h in the air-flow direction and a maximum strut width b transversely to the air-flow direction. The strut profile may have various cross sections in a radial direction, that is to say different heights and/or widths--for which reason a further strut profile 4*b* having a smaller cross section is shown. The struts 4 have front or leading edges 6 and rear or trailing edges 7, in each case represented by dashed lines. In this exemplary embodiment both the front edges 6 and the rear edges 7 are curved in opposition to the air-flow direction, that is to say toward the radiator 1 and in each case span an area enveloping the struts 4, which forms a part of the surface of a spheroid, that is to say a body of revolution. Such a spheroid is generated by the rotation of a curve branch (a so-called generatrix) about an axis of rotation; in the exemplary embodiment shown the generatrices are the front edges 6 and the rear edges 7 of the struts 4, that is to say both lie in the plane of projection. They each have a non-linear curve path, that is to say the front edge 6 and the rear edge 7 could be arcs of a parabola, for example. This non-linear curve path produces a varying distance x between the rear edge 7 of the struts 4 and the entry plane B of the axial-flow fan 3*a*, that is to say it results in a minimum distance x.sub.i radially inward and a maximum distance x.sub.a radially outward. The distance x therefore increases non-linearly (progressively) with increasing radius (distance from the axis of rotation 3*c*). The curvature described gives the struts 4 an increased design strength, that is to say the arched configuration, in which the struts 4 as it were form the framework of a dome, produces a bracing effect, especially under axial loading in the direction of the axis of rotation 3*c*. Since the highest circumferential and flow velocities occur in the blade tip area of the axial-flow fan 3*a*, the increased distance x.sub.a between struts 4 and fan 3*a* produces improved flow conditions in this area, which leads to noise reductions and increased efficiency. Under axial loading the struts 4 are subjected to bending stresses, which are greatest in the radially outer area, that is to say in the area of the largest distance x. Although the inventive arching alone provides greater strength in this area through increased design strength, it may be advantageous to enlarge the strut cross section 4*a* in this area, that is to say either by increasing the strut height h or increasing the strut width b or both of these, thereby affording a slender profile and both strength and aerodynamic advantages.

Figure 2:
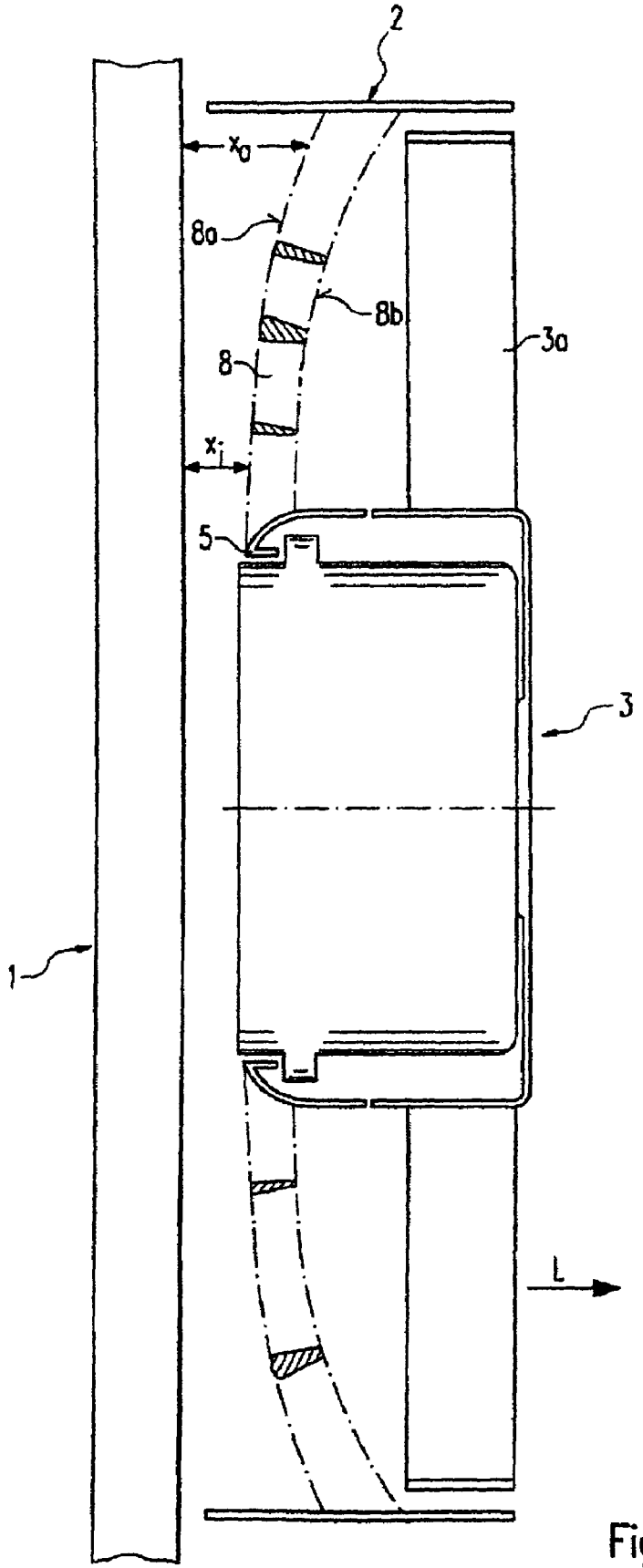
FIG. 2 shows a second exemplary embodiment of the invention with struts, curved in the air-flow direction, between the heat exchanger and the fan.

FIG. 2 shows a second exemplary embodiment of the invention, the same reference numerals being used for the same parts, that is to say 1 for the heat exchanger, 3 for the blower and 2 for the fan housing. By means of the retaining ring 5 the blower 3 is fixed in relation to the fan housing 2 via struts 8, the struts 8 having front edges 8*a* and rear edges 8*b*, which are here curved in the direction of the air flow, according to the arrow L. In this case, therefore, the axial distance $x_i$ in the radially inner area between the network of the heat exchanger 1 and the front edge 8*a* is smaller than the distance $x_a$ in the radially outer area. The struts 8 are therefore laterally inverted about a radial plane compared to the struts 4 in FIG. 1. The bracing effect due to the dome-like arching of the struts 8 is here therefore the same as in the exemplary embodiment according to FIG. 1. The fan housing 2 is preferably fixed to the heat exchanger 1, that is to say the forces emanating from the blower 3 and transmitted via the struts 8 are absorbed by the heat exchanger 1 and its mounting in the vehicle. Bracing of the fan housing 2 is also possible in some other, for example directly in relation to the vehicle.

Figure 3:
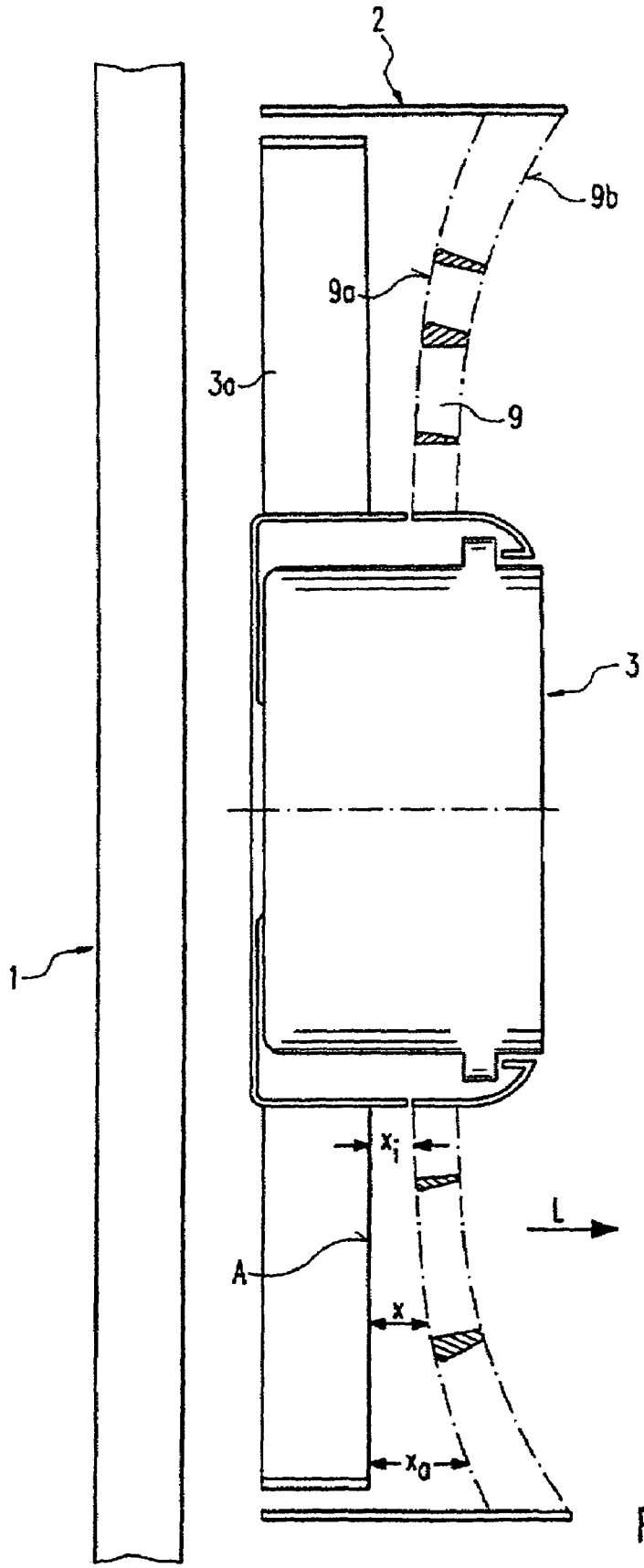
FIG. 3 shows a third exemplary embodiment of the invention with struts, curved in the air-flow direction, downstream of the fan.

FIG. 3 shows a further (third) exemplary embodiment of the invention, in which the blower 3 is secured by struts 9 in relation to the fan housing 2 and the struts 9 are arranged downstream of the fan 3*a*. The struts 9 have a front edge 9*a* and a rear edge 9*b*, which are curved in the direction of the air flow. The distance x between an outlet plane A of the axial-flow fan 3*a* and the front edge 9*a* of the struts 9 therefore increases with increasing radius, that is to say the outer distance $x_a$ is greater than the inner distance $x_i$, x increasing progressively from $x_i$ to $x_a$. In this solution also aerodynamic advantages ensue, particularly in the radially outer area, together with a noise reduction and increased efficiency.

Figure 4:
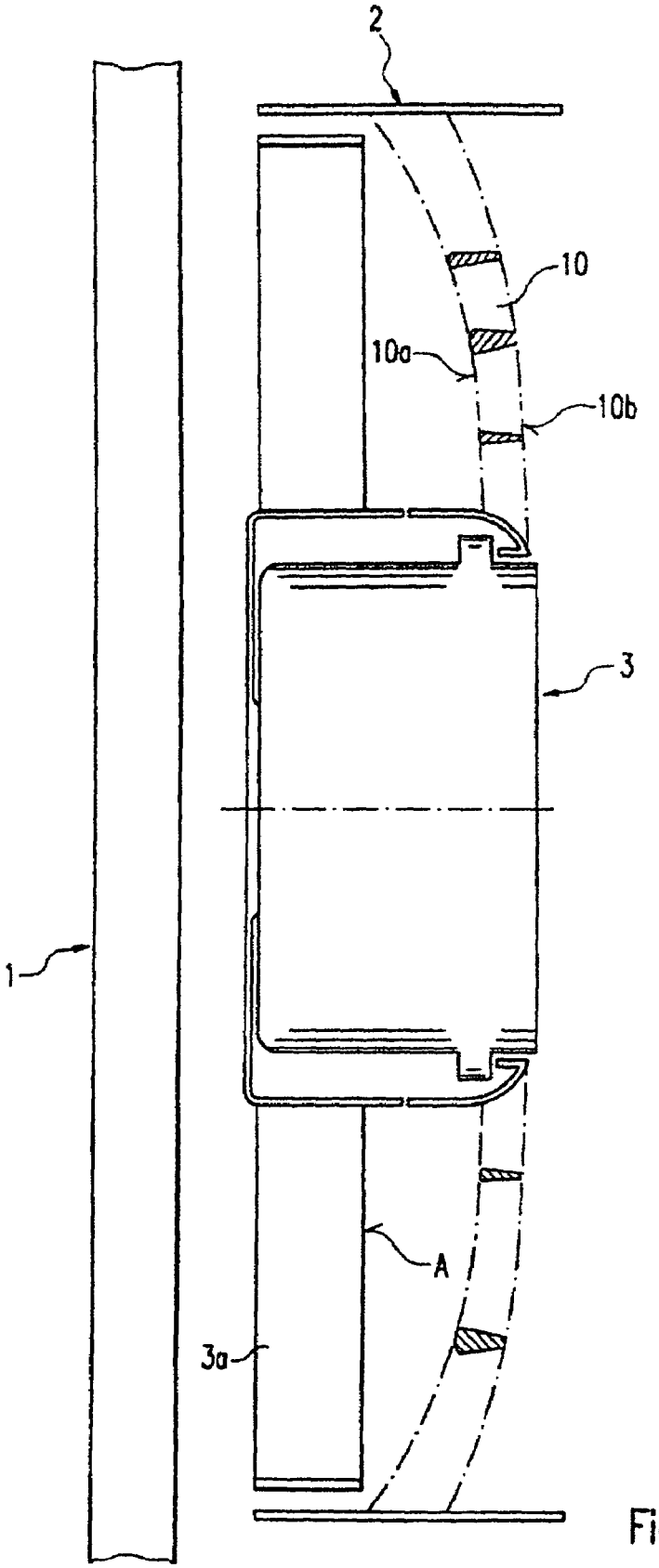
FIG. 4 shows a fourth exemplary embodiment of the invention with struts, curved in opposition to the air-flow direction, downstream of the fan.

FIG. 4 shows a further (fourth) exemplary embodiment of the invention, in which the blower 3 is braced in relation to the fan housing 2 by struts 10. The struts 10 have front edges 10*a* and rear edges 10*b*, which are curved in opposition, to the air-flow direction and are arranged behind the outlet plane A of the axial-flow fan 3*a*. This embodiment therefore represents a lateral inversion of the embodiment according to FIG. 3. The bracing effect according to the invention is also present here owing to the dome-shaped arching of the struts 10.

Figure 5:
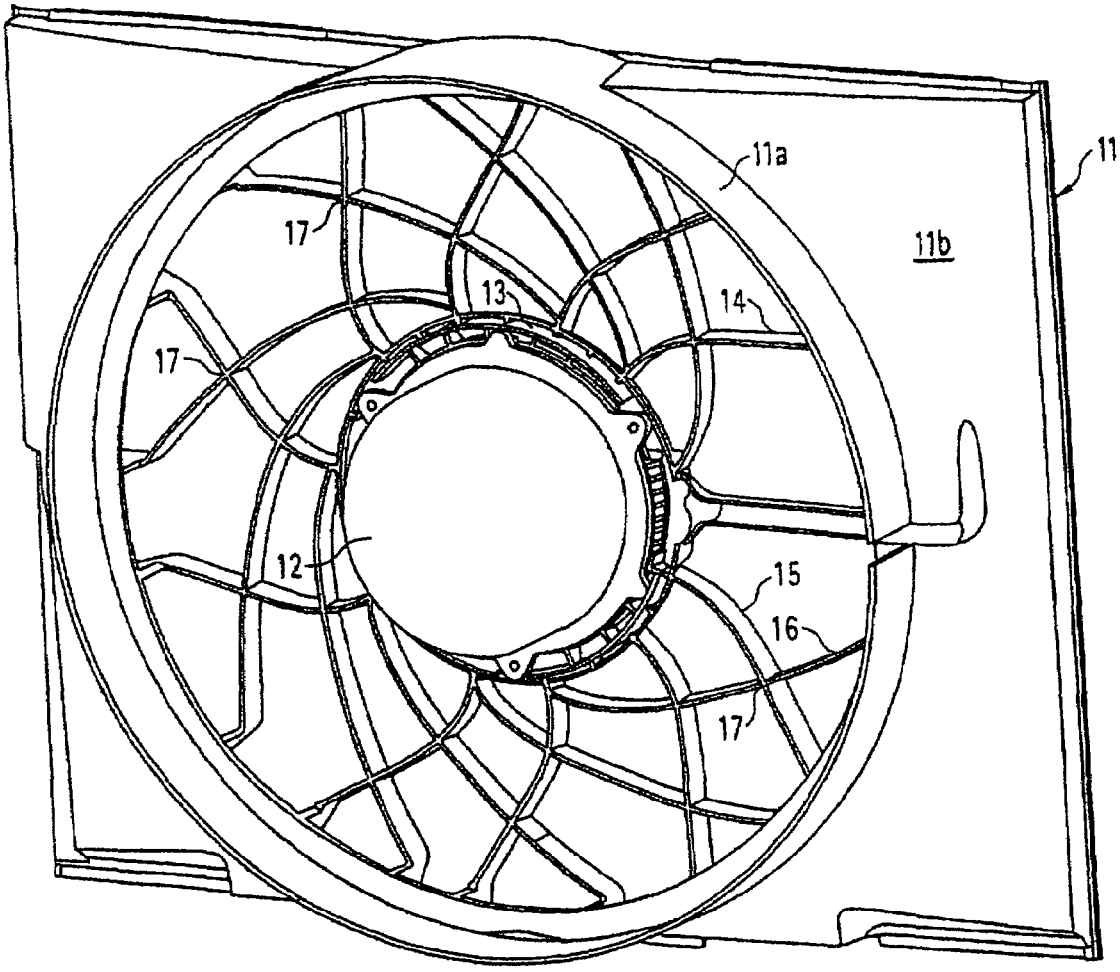
FIG. 5 shows a fifth exemplary embodiment of the invention with a strut lattice, viewed in the opposite direction to the air-flow direction.

FIG. 5 shows a further (fifth) exemplary embodiment of the invention, that is a fan housing 11 with a fan case 11*a*, inside which an electric motor 12 is arranged for driving a fan wheel (not shown). The fan housing 11 is shown from its rear side 11*b* and at its front side is connected in a manner not shown to a heat exchanger, likewise not represented. The electric motor 12 is accommodated in a retaining ring 13, which is connected via a strut lattice 14 to the fan housing 11. The strut lattice 14 comprises struts 15, which are curved clockwise in a circumferential direction, and struts 16 which are curved in the opposite circumferential direction. The struts 15, 16 are arranged in such a way that multiple points of intersection 17 are formed between them, which together with the struts 15, 16 form the lattice structure 14. In a division of functions, some of the struts may take the form of compression struts 15 and other struts that of tensile struts 16, thereby also increasing the radial rigidity. The tensile struts may be of more slender design, that is to say with a smaller cross section. The fan housing 11 including the case 11*a*, strut lattice 14 and retaining ring 13 may be manufactured as an integral plastic injection molding. The strut lattice 14, comprising struts 15, 16 curved in a circumferential direction may be arranged both in one plane and also on the surface of a spheroid—as described in the preceding exemplary embodiments. Through the additional dome-shaped arching of the strut lattice 14 it is therefore possible to achieve an additional axial rigidity by increasing the design strength.

Figure 6:
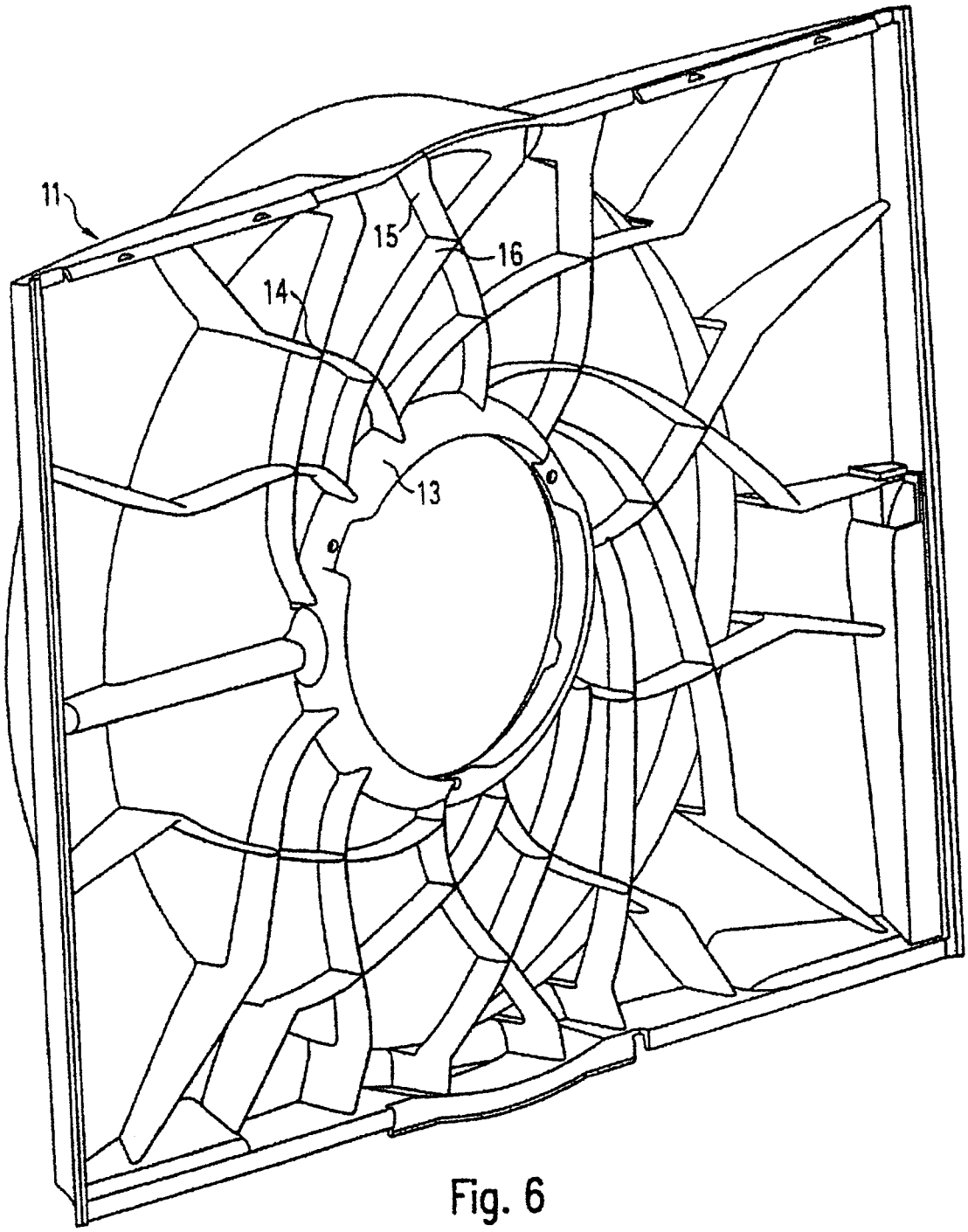
FIG. 6 shows the exemplary embodiment according to FIG. 5 viewed in the air-flow direction toward the fan housing with strut lattice.

FIG. 6 shows the fan housing 11 according to FIG. 5 viewed in the air-flow direction with struts 15, 16, which form the strut lattice 14 for holding the retaining ring 13—the blower is not shown here.

The exemplary embodiments described above relate to an intake fan, that is to say an arrangement of fan housing and fan blower downstream of the heat exchanger in the air-flow direction. The scope of the invention also encompasses a fan housing arrangement with pressurizing fan, that is to say one upstream of the heat exchanger in the air-flow direction.

Figure 7:
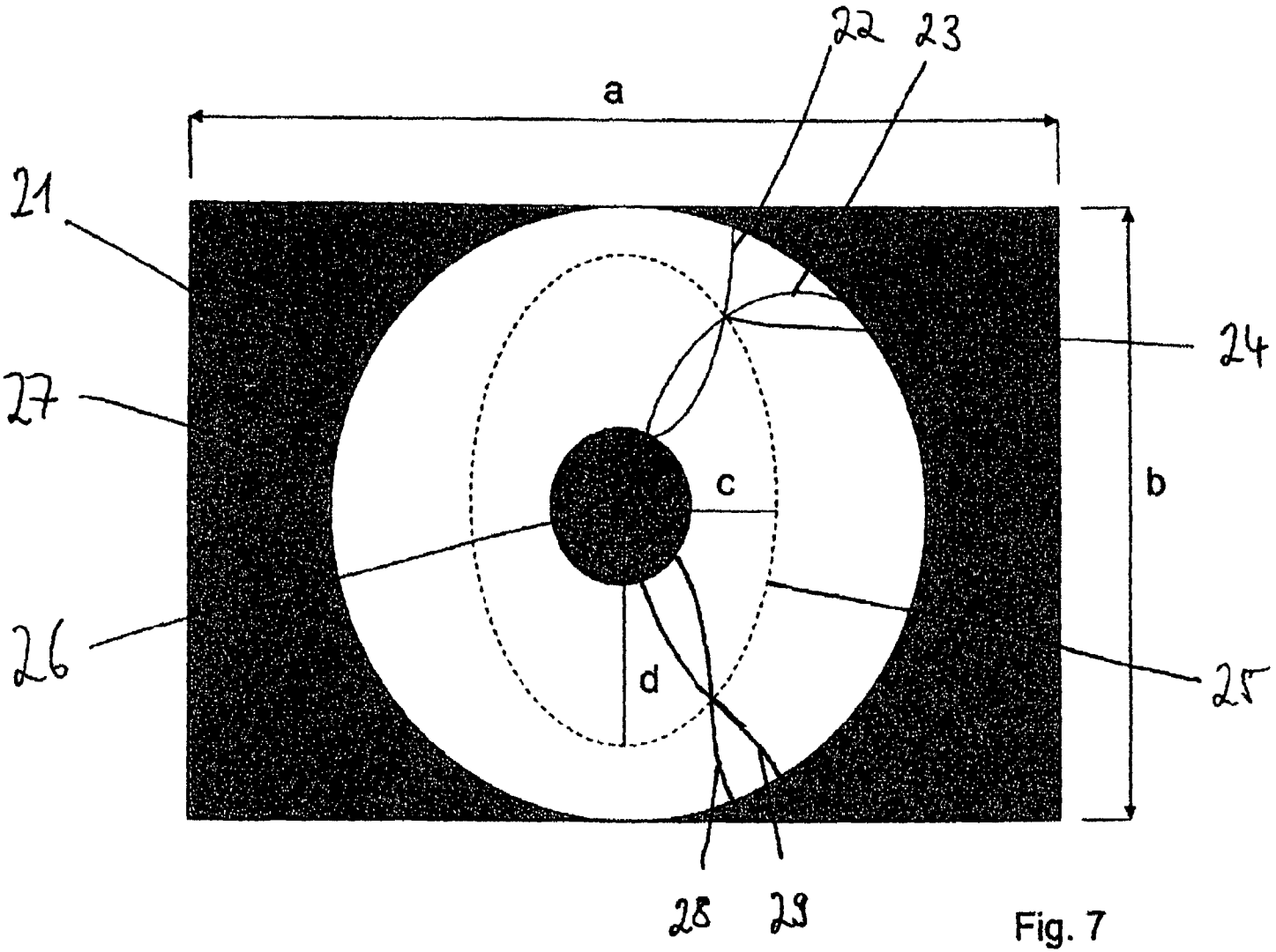
FIG. 7 shows a schematic view of a fan housing with crossed struts.

FIG. 7 shows a schematic view of a fan housing 21 viewed in the air-flow direction merely indicating the struts 22, 23, 28, 29, which cross at a point of intersection 24. The shape of each of the pairs of struts 22, 23 and 28, 29 is in this case to be adapted to the stability requirements in each instance. Further points of intersection, not explicitly shown are arranged along an ellipse 25 with semi-axes c and d. In the area of the ellipse 25 the throughflow is largely axial, that is to say perpendicular to the plane of projection of FIG. 7. Since the points of intersection represent an increased flow resistance in the case of throughflow having a component inside the plane of projection of FIG. 7, a total flow resistance of the fan housing 21 is reduced with this arrangement. CFD flow simulations for a rectangular fan housing without struts likewise lead to an elliptical shape.

In the present exemplary embodiment the throughflow inside the ellipse 25 is directed obliquely outward owing to a deflection through the fan hub 26, and therefore has a radial component outward. Outside the ellipse the throughflow is directed obliquely inward owing to a deflection through the outer face 27 of the fan housing 21, and therefore has a radial component inward.

This inwardly directed radial component is all the more pronounced the wider the outer face 27. The elliptical shape therefore ensues from the elongated rectangular shape of the fan housing 21. With rectangular fan housings having edge lengths a and b according to FIG. 7 and circular fan openings, an ellipse generally results, having the semi-axes c and d, b being smaller than a and c being smaller than d. The elongated shape of the ellipse is therefore turned through 90° compared to the elongated shape of the fan housing.

In the case of a square fan housing a circle accordingly results as a special instance of an ellipse.

The invention claimed is:

1. A fan housing for an air-flow heat exchanger comprising a fan blower comprising:

an axial-flow fan and a drive motor, wherein the blower is connected to the fan housing by struts, and wherein the struts have a cross-sectional profile with a front edge and a rear edge and a strut height h and a strut width b, wherein the front edges of the struts are arranged in a non-planar, spherical or spheroidal surface;

wherein the surface is generated by a non-linear curve branch rotating about the axis of rotation of the blower, the branch comprising a distance x from a radial plane that increases with increasing distance from the axis of rotation, wherein the curve branch is curved in the air-flow direction L;

wherein the struts are arranged to form a strut lattice having points of intersection; and wherein the points of intersection are arranged on an ellipse.

2. The fan housing as claimed in claim 1, wherein the struts are arranged inclined or curved in opposite circumferential directions.

3. The fan housing as claimed in claim 1, wherein the rear edges of the struts are arranged in a non-planar, spherical or spheroidal surface.

4. A fan housing for an air-flow heat exchanger comprising a fan blower comprising:

an axial-flow fan and a drive motor, wherein the blower is connected to the fan housing by struts, and wherein the struts have a cross-sectional profile with a front edge and a rear edge and a strut height h and a strut width b, wherein the front and/or the rear edges of the struts are arranged in a non-planar, spherical or spheroidal surface, wherein the strut cross section increases with increasing distance from the axis of rotation, wherein the struts are arranged to form a strut lattice having points of intersection, and wherein the points of intersection are arranged on an ellipse.

5. The fan housing as claimed in claim 4, wherein the strut height h increases with increasing distance from the axis of rotation.

6. The fan housing as claimed in claim 4, wherein the strut width b increases with increasing distance from the axis of rotation.

7. A fan housing for an air-flow heat exchanger comprising a fan blower comprising:

an axial-flow fan and a drive motor, wherein the blower is connected to the fan housing by struts, wherein the struts are arranged inclined or curved in opposite circumferential directions and form a strut lattice having points of intersection; and wherein the points of intersection are arranged on an ellipse.

8. The fan housing as claimed in claim 7, wherein the struts take the form of compression struts in one circumferential direction and tensile struts in the other circumferential direction, the compression struts having a larger cross section than the tensile struts.

9. The fan housing as claimed in claim 7, wherein the points of intersection are arranged in areas having a basically axial throughflow.

10. The fan housing as claimed in claim 7, wherein a length ratio of the major axes of the ellipse corresponds to the reciprocal of a length ratio of the side edges of the fan housing parallel to each of these respectively.

11. The fan housing as claimed in claim 7, wherein the struts intersect each other within a plane at the points of intersection.

12. A fan housing for an air-flow heat exchanger comprising a fan blower comprising:

an axial-flow fan and a drive motor, wherein the blower is connected to the fan housing by struts, wherein the struts are arranged inclined or curved in opposite circumferential directions and form a strut lattice having points of intersection;

wherein the points of intersection are arranged on an ellipse; and wherein the struts are fixed to each other at the points of intersection.

* * * * *